US008549781B2

(12) United States Patent
Zamlinsky et al.

(10) Patent No.: US 8,549,781 B2
(45) Date of Patent: Oct. 8, 2013

(54) TRIGGER EXTENSION APPARATUS AND SYSTEM AND METHOD THEREFOR

(76) Inventors: Alex Zamlinsky, Roswell, GA (US); Mark Gallo, Atlanta, GA (US)

( * ) Notice: Subject to any disclaimer, the term of this patent is extended or adjusted under 35 U.S.C. 154(b) by 207 days.

(21) Appl. No.: 12/033,747

(22) Filed: Feb. 19, 2008

(65) Prior Publication Data

US 2012/0186122 A1 Jul. 26, 2012

(51) Int. Cl.
*F41A 19/10* (2006.01)

(52) U.S. Cl.
USPC ..... 42/71.01; 42/DIG. 1; 89/27.3

(58) Field of Classification Search
USPC ..... 42/69.01, 69.02, 71.01, 72, DIG. 1, 42/73; 89/136, 27.3, 27.11; 124/31
See application file for complete search history.

(56) References Cited

U.S. PATENT DOCUMENTS

| | | | | | |
|---|---|---|---|---|---|
| 1,307,594 | A | * | 6/1919 | Newman | 89/1.1 |
| 1,909,425 | A | * | 5/1933 | Reid | 42/69.01 |
| 2,457,296 | A | * | 12/1948 | Yawman | 42/69.01 |
| 2,586,317 | A | * | 2/1952 | Fay | 42/42.01 |
| 2,589,227 | A | * | 3/1952 | Colley | 42/69.01 |
| 2,920,413 | A | * | 1/1960 | Marhefka et al. | 42/69.01 |
| 3,091,878 | A | * | 6/1963 | Savioli | 42/69.01 |
| 3,184,875 | A | * | 5/1965 | Klebe | 42/69.01 |
| 3,206,884 | A | * | 9/1965 | Purvis | 42/69.02 |
| 3,611,607 | A | | 8/1969 | Donnell | |
| 3,488,488 | A | * | 1/1970 | Crouch | 42/146 |
| 4,499,683 | A | * | 2/1985 | Savioli | 42/69.01 |
| 4,601,123 | A | * | 7/1986 | Swearengen et al. | 42/72 |
| 4,667,429 | A | * | 5/1987 | Perazzi | 42/69.01 |
| 4,677,781 | A | * | 7/1987 | Lee | 42/70.01 |
| 4,685,379 | A | | 8/1987 | Troncoso | |
| 4,691,461 | A | * | 9/1987 | Behlert | 42/69.01 |
| 4,803,910 | A | * | 2/1989 | Troncoso | 89/27.3 |
| 4,869,008 | A | * | 9/1989 | Rasmussen | 42/71.01 |
| 5,780,762 | A | * | 7/1998 | Kobayashi | 89/140 |
| 5,797,206 | A | | 8/1998 | Vitorino | |
| 6,250,194 | B1 | | 6/2001 | Brandl et al. | |
| 6,367,465 | B1 | | 4/2002 | Buccieri, Jr. | |
| 6,526,683 | B1 | * | 3/2003 | Crandall | 42/40 |
| 6,598,329 | B1 | | 7/2003 | Alexander | |
| 6,807,763 | B1 | | 10/2004 | Leung | |
| 6,901,691 | B1 | | 6/2005 | Little | |
| 7,146,762 | B1 | | 12/2006 | Leung | |
| 7,231,861 | B1 | | 6/2007 | Gauny et al. | |
| 7,487,768 | B2 | * | 2/2009 | Hatcher | 124/31 |
| 2006/0048425 | A1 | | 3/2006 | Frickey | |
| 2006/0048426 | A1 | | 3/2006 | Crandall et al. | |
| 2006/0048427 | A1 | | 3/2006 | Crandall et al. | |
| 2006/0048429 | A1 | | 3/2006 | Crandall et al. | |
| 2006/0048430 | A1 | | 3/2006 | Crandall et al. | |

OTHER PUBLICATIONS

Dave Sutherland, SKS Bullpups [online], [retrieved on Aug. 21, 2007], Retrieved from the internet: <URL: http://www.simonov.net/bullpup.htm>.

(Continued)

*Primary Examiner* — Michael Carone
*Assistant Examiner* — Reginald Tillman, Jr.
(74) *Attorney, Agent, or Firm* — F. Wayne Thompson, Jr.

(57) ABSTRACT

A removable, non-permanent trigger extension that does not require gunsmithing and is operable with a firearm to provide a contact surface adapted to be manipulated by a user to actuate a trigger assembly of the firearm, wherein the contact surface is disposed a location spaced from a location of the trigger and a rifle stock operable with the trigger extension and the firearm.

14 Claims, 7 Drawing Sheets

(56) References Cited

OTHER PUBLICATIONS

Dave Sutherland, SKS Bullpups [online], [archived on Mar. 3, 2001], [retrieved on Aug. 21, 2007], Retrieved from the internet: <URL: http://web.archive.org/web/20010303045437/http://www.simonov.net/bullpup.htm>.

Rifle Tech [online], [retrieved on Aug. 21, 2007], Retrieved from the internet: <URL: http://www.rifletech.com/bullpup.htm>.

Rifle Tech [online], [archived on Dec. 19, 2002], [retrieved on Aug. 21, 2007], Retrieved from the internet: <URL: http://web.archive.org/web/20021219113231/http://rifletech.com/bullpup.htm>.

* cited by examiner 411
413
420
420

413
419
415
420
425
420

TRIGGER EXTENSION APPARATUS AND SYSTEM AND METHOD THEREFOR

TECHNICAL FIELD

The present invention relates generally to firearms, and, more specifically, to an apparatus, system, and method for altering the position of a trigger of a firearm.

BACKGROUND OF THE INVENTION

Shooting sports and firearm collection are enjoyable pastimes for many individuals. In particular, hobbies involving the collection, restoration, conversion, modification, and/or shooting of historic and exotic military firearms are popular. Rifles figure prominently in such hobbies, and the sales of both original and modified firearms, along with associated parts and accessories, represent a large portion of the commerce surrounding such hobbies.

In certain instances, hobbyists may wish to replace original components with customized or modified components in order to alter the appearance and/or the functionality of the firearm. For example, replacement stocks for numerous models of rifles are available from multiple manufacturers, and may be purchased and installed by rifle owners and hobbyists for any of a number of reasons, such as to modernize the firearm's appearance, to reduce weight, to modify a shooting position, to add or modify mounting points for accessories, or the like. One of the more radical types of reconfiguration involves relocating the position of the trigger. Such repositioning is typically technically difficult, and if performed improperly can adversely impact the function, reliability, and/or safety of the firearm. Therefore trigger modification is typically performed only by professional gunsmiths, or the like. Nonetheless, a large demand exists for rifles having repositioned triggers.

Thus, it is clear that there is an unmet need for a removable apparatus, system, and method for repositioning a trigger of a rifle that may be installed successfully by amateur hobbyists, i.e. that does not require gunsmithing, and that provides for easy, safe, and reliable use of the trigger.

BRIEF SUMMARY OF THE INVENTION

Briefly described, in a preferred embodiment, the present invention overcomes the above-mentioned disadvantages and meets the recognized need for such an apparatus, system, and method for repositioning the trigger of a rifle by providing a modified stock engageable with a rifle and a trigger extension, wherein the location of the trigger access of the modified stock is spaced from the trigger assembly of the rifle, and wherein the trigger extension operates to actuate the trigger assembly without modification of the trigger assembly itself.

According to its major aspects, and broadly stated, the present invention comprises a trigger extension that is removably operable with a trigger assembly of a rifle and/or the modified stock, wherein activation of the trigger extension by a user activates the trigger assembly of the rifle, causing the weapon to fire. The length of the trigger extension determines the position of the access point of the trigger assembly for the user, and in some embodiments, the trigger extension may have an adjustable length. Such relocation of the trigger access point preferably enables alternative configurations for the rifle. The system further comprises a modified stock adapted to receive the rifle barrel, trigger mechanism, magazine, and the like, along with the trigger extension engaged with the trigger assembly. The modified stock preferably includes a relocated grip, wherein the trigger extension is operable by a user while grasping the relocated grip of the modified stock. The grip may be formed as a pistol grip, if desired.

The trigger extension is preferably formed having an exterior surface on a forward end thereof adapted to be actuated by a user and rearwardly-extending arms adapted to transfer a force applied to the surface to a trigger engaging portion on a rearward end thereof. The rearwardly-extending arms preferably extend around, and optionally engage, a trigger guard of the rifle trigger assembly. The trigger engaging portion is preferably connected to at least one of the rearwardly-extending arms for transmission of the force thereto, and preferably engages the trigger of the rifle.

The modified stock is preferably adapted to receive a rifle barrel, a receiver, a bolt assembly, a trigger assembly, and a magazine assembly. The modified stock preferably provides a cavity for receiving and enclosing at least the trigger assembly of the rifle, wherein a user may preferably not access the trigger of the trigger assembly directly while the trigger assembly is installed in the modified stock. The modified stock further preferably includes a channel or other means for slidably receiving the trigger extension, wherein at least a portion of forward surface of the trigger extension is accessible to a user for activation of the firing mechanism of the rifle. The trigger extension preferably engages, and is guided by, the modified stock, whereby the trigger extension is capable solely of motion in a direction to activate the trigger of the rifle. In a preferred embodiment, the trigger extension extends from the trigger of the rifle in a forward direction, i.e. towards the barrel or in a direction of fire, and has a length sufficient to dispose the forward surface of the trigger extension well in front of a the trigger guard of trigger assembly of the rifle, such as in a position where a user may activate either of both of the trigger, through the trigger extension, and another element of the rifle, such as a magazine release mechanism, with the same finger, and without needing to reposition the user's hand, i.e. without having to release the grip with the hand of the user's trigger finger. Such repositioning of the trigger access point of the rifle preferably allows selective modification of other features of the rifle. For example, by repositioning the trigger access point forward, the length-of-pull of the rifle may be increased without increasing the overall length of the rifle. Similarly, if the trigger access point is repositioned, but the stock is designed to maintain the original length-of-pull, i.e. the stock is shortened, the balance of the rifle may be adjusted to suit a user's preference, to reduce the overall length dimension of the rifle, to reduce weight, or the like.

Accordingly, one feature and advantage of the present invention is its ability to allow the access point for a trigger assembly of a rifle to be repositioned without modification of the trigger assembly, the receiver, the bolt assembly, the barrel, or the like.

Another feature and advantage of the present invention is its ability to provide a rifle stock adapted to receive a trigger extension and optionally having a pistol grip, or other modified characteristic.

These and other features and advantages of the present invention will become more apparent to those ordinarily skilled in the art after reading the following Detailed Description of the Invention and Claims in light of the accompanying drawing Figures.

BRIEF DESCRIPTION OF THE DRAWINGS

Accordingly, the present invention will be understood best through consideration of, and with reference to, the following drawing Figures, viewed in conjunction with the Detailed Description of the Invention referring thereto, in which like reference numbers throughout the various Figures designate like structure, and in which.

Figure 1:
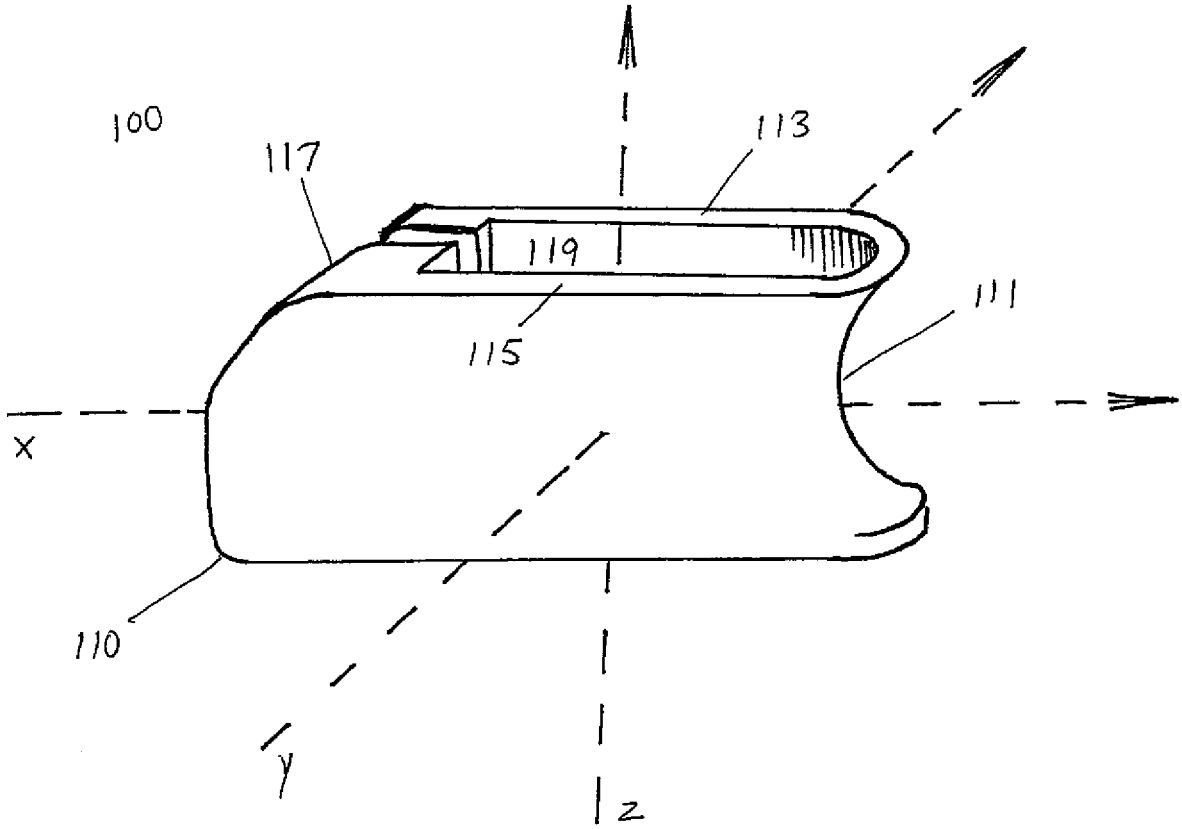
FIG. 1 is a perspective view of a trigger extension according to the present invention.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF THE INVENTION

In describing preferred embodiments of the present invention illustrated in the drawings, specific terminology is employed for the sake of clarity. The invention, however, is not intended to be limited to the specific terminology so selected, and it is to be understood that each specific element includes all technical equivalents that operate in a similar manner to accomplish a similar purpose.

Figure 2:
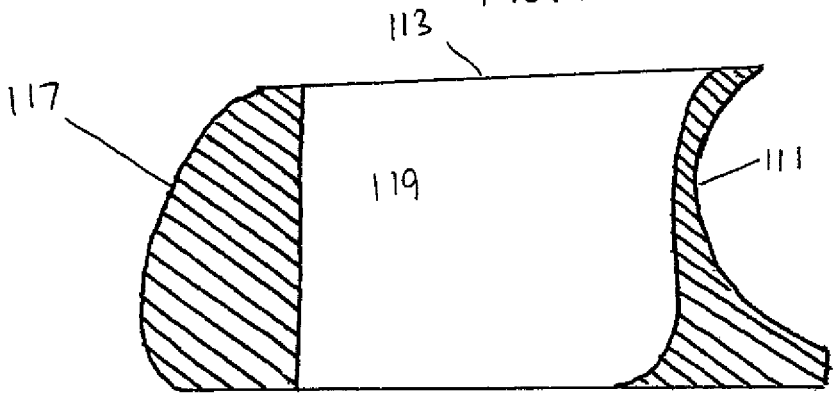
FIG. 2 is a side cross-sectional view of the trigger extension of FIG. 1.
Figure 3:
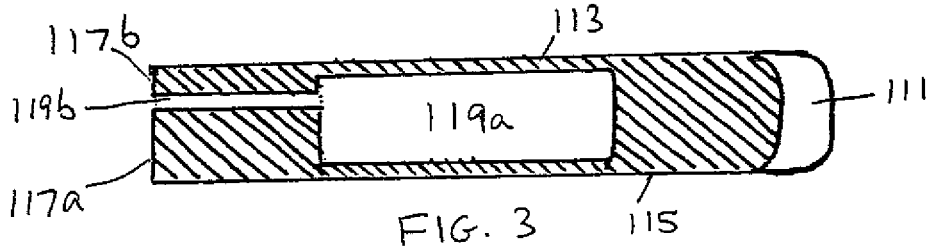
FIG. 3 is a top cross-sectional view of the trigger extension of FIG. 1.

In that form of the preferred embodiment of the present invention chosen for purposes of illustration, FIGS. 1-3 show trigger extension 100 formed from monolithic body 110 having forward contact portion 111, two rearwardly-extending arms 113 and 115, and trigger contact portion 117. Rearwardly-extending arms 113 and 115 preferably define cavity 119 therebetween. Body 110 may be formed from any suitable material, such as wood, plastic, metal, composite, combinations thereof, or the like, whereby arms 113 and 115 may extend around a trigger guard (such as trigger guard TG of FIGS. 5 and 6) of a rifle with which trigger extension 100 may be used, and may exhibit sufficient strength to transfer a force necessary to overcome a biasing force of a trigger of a rifle with which trigger extension 100 is engaged, such as a force of 8 pounds or more. As will be understood by those skilled in the art, forward contact portion 111 may be formed in any desired shape, such as a saddle shape designed to provide a comfortable and a secure contact surface for a user. Similarly, trigger contact portion 117 may be formed to provide a secure engagement with a trigger of the rifle, such as having a contour matching that of the trigger, whereby activation of the trigger via trigger extension 100 may be smooth and reduce slippage between the trigger and trigger contact surface 117.

Referring more particularly to FIG. 3, cavity 119 comprises first portion 119*a* and second portion 119*b*, wherein first portion 119*a* is preferably configured to accommodate a trigger guard of a trigger assembly of a rifle therein. Thus, first portion 119*a* preferably defines a space in the first direction of axis Y between arms 113 and 115 of sufficient dimension to receive the width of the trigger guard in the first direction without excessive frictional engagement that may interfere with activation of the trigger. Additionally, first portion 119*a* preferably defines a space in the second direction of axis X between forward contact portion 111 and trigger contact portion 117 of sufficient dimension to allow motion of trigger extension in the second direction relative to the trigger housing. As will be understood by those ordinarily skilled in the art, the minimum amount of motion in the second direction is equal to the amount of motion in the second direction necessary to actuate the trigger, i.e. to complete firing of the weapon and resetting the trigger. Preferably, first portion 119*a* defines a space having a dimension in the second direction greater than such a minimum distance, whereby trigger extension may preferably travel with the travel of the trigger of the rifle in the second direction during use.

Second portion 119*b* is preferably configured to allow trigger contact portion 117 to be disposed within a trigger guard of the rifle that completely surrounds the trigger, at least in one plane. Second portion 119*b* may define first portion 117*a* and second portion 117*b* of trigger contact portion 117, and may be formed as a space having a dimension in the first direction equal to the width of the trigger guard. Such space may allow trigger extension 100 may slip over the trigger guard without flexing and be arranged such that trigger contact portion 117 is disposed proximate the trigger of the rifle. Alternatively, and as illustrated in FIG. 3, second portion 119*b* may optionally define a space having a distance in the first direction substantially less than the width of the trigger guard, such as a distance less than the width of the trigger. Accordingly, arms 113 and 115 may be separated, at least temporarily, to increase the dimension of second portion 119*b* in the second direction in order to allow trigger contact portion 117 to be disposed within the trigger guard proximate the trigger. Such relatively smaller dimension of second portion 119*b* may reduce or eliminate a chance of the trigger of the rifle slipping into the space of second portion 119*b*. To further reduce such a chance of the trigger slipping into the space of second portion 119*b*, a dimension of first portion 117*a* in the first direction may preferably be greater than the dimension of second portion 117*b* in the first direction, whereby the trigger is preferably disposed proximate a point of first portion 117*a* spaced from second portion 119*b*.

Figure 4:
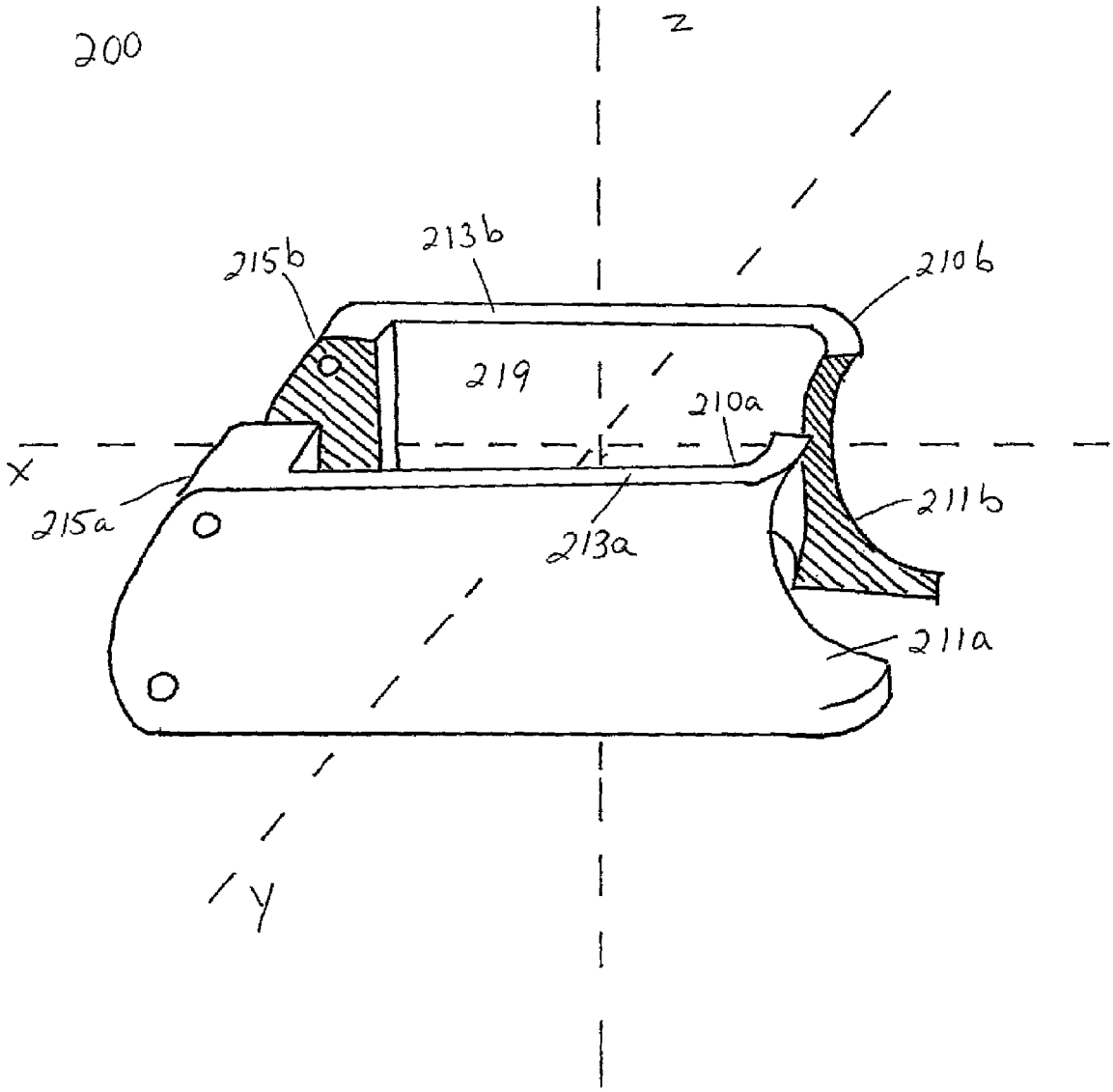
FIG. 4 is an exploded perspective view of another trigger extension according to the present invention.

As will be understood by those ordinarily skilled in the art, alternate configurations for trigger extension 100 are possible, such as the alternate configuration illustrated in FIG. 4. Trigger extension 200, preferably includes two opposing members that, when attached together, function in the same way as trigger extension 100. More specifically, trigger extension 200 may include first portion 210*a* and second portion 210*b*, each comprising forward contact portions 211*a*, 211*b*, rearwardly-extending arms 213*a*, 213*b*, and trigger contact portion 215*a*, 215*b*, respectively. First portion 210*a* and second portion 210*b* preferably combine to provide a secure and comfortable surface for use in firing the rifle. Rearwardly-extending arms 213*a* and 213*b* preferably define cavity 219 adapted to accept a trigger guard therein, and carry trigger contact portions 215*a* and 215*b*, respectively. First portion 210*a* and second portion 210*b* may preferably be disposed encircling a trigger guard of a rifle such that trigger contact portions 215*a* and 215*b* are disposed proximate the trigger, and may be mutually secured via mechanical fasteners, adhesive, welding, or the like. Thereafter, a user may press forward contact portions 211*a* and/or 211*b* to activate the trigger.

As another alternative, not shown, one or the other of first portion 210*a* and second portion 210*b* may be omitted. In the case where second portion 210*b* is omitted, the length of one or both of forward contact portion 211*a* and trigger contact portion 215*a* may be increased in the first direction of axis Y to ensure proper engagement of trigger contact portion 215*a* with the trigger, and to ensure adequate surface area of forward contact portion 211*a* for a user to manipulate. Such increased length in the first direction preferably further serves to reduce or eliminate a chance that first portion 210*a* will become disengaged from the trigger of the rifle.

Figure 5:
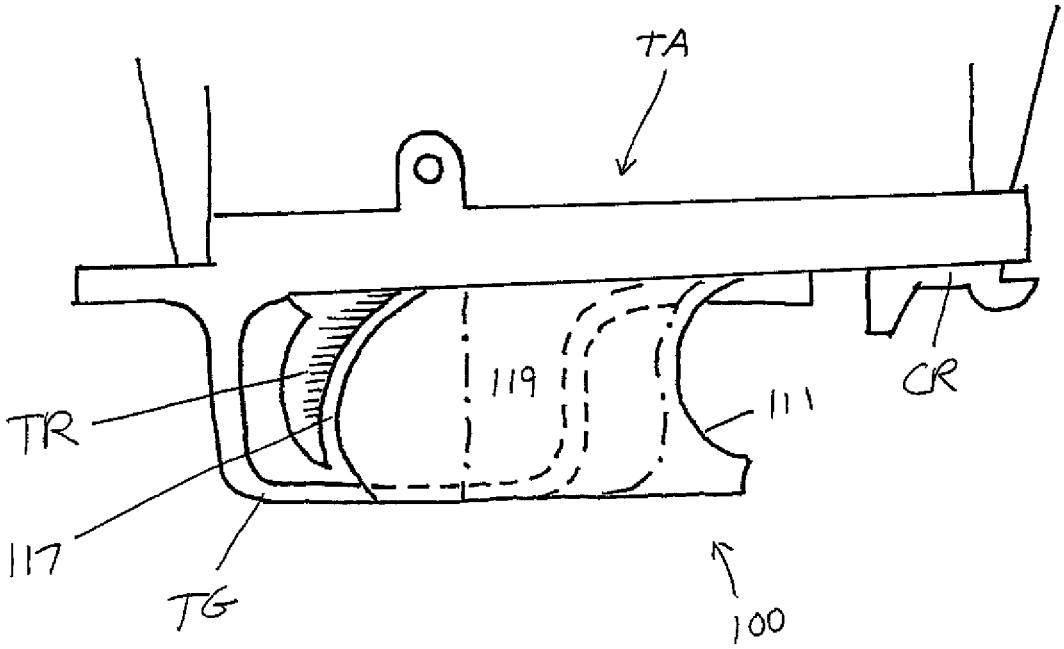
FIG. 5 is a side view of the trigger extension of FIG. 1 in combination with a trigger assembly of an assault rifle.
Figure 6:
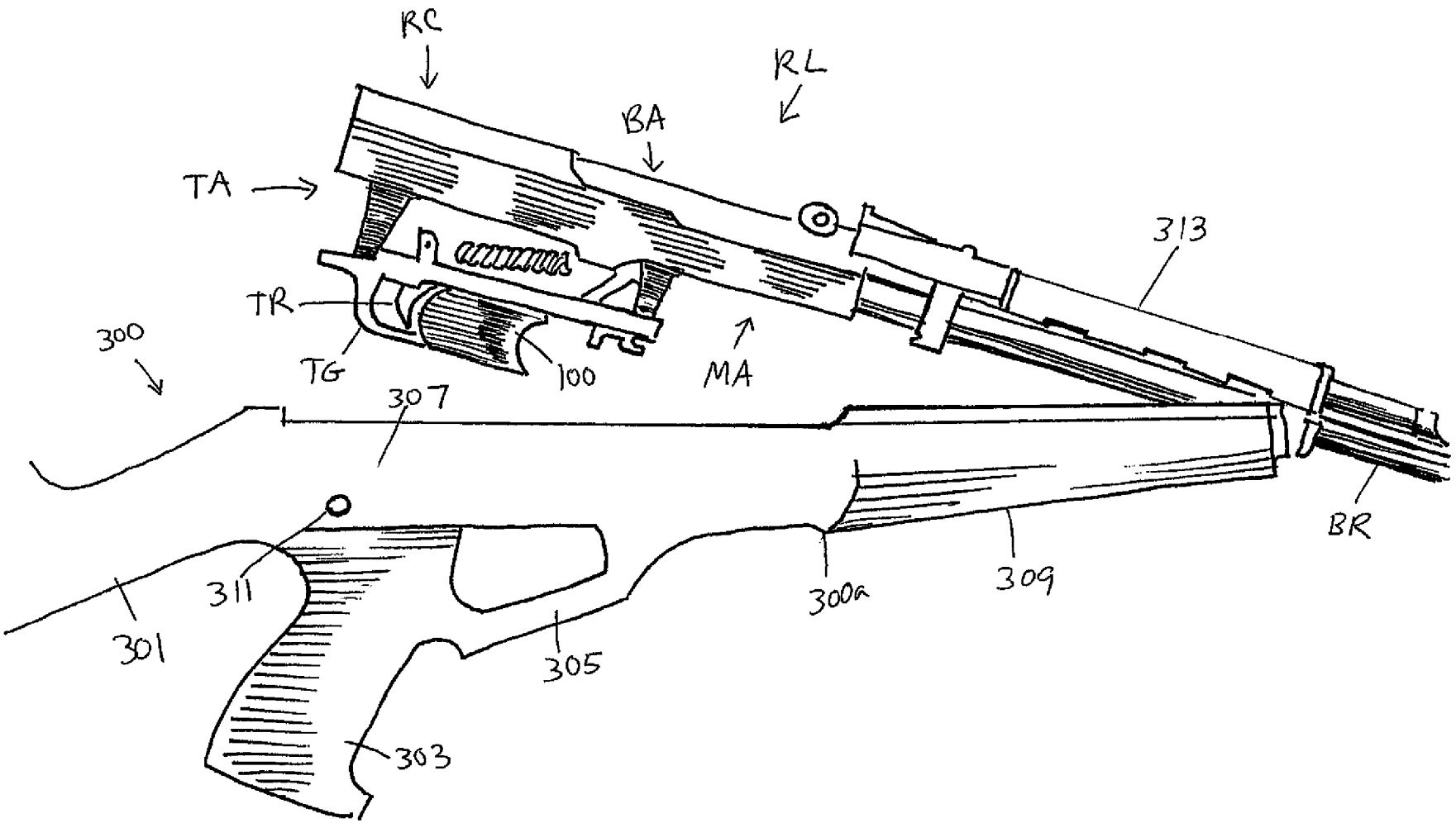
FIG. 6 is a side view of a modified stock according to the present invention operable in combination with a trigger extension.
Figure 7:
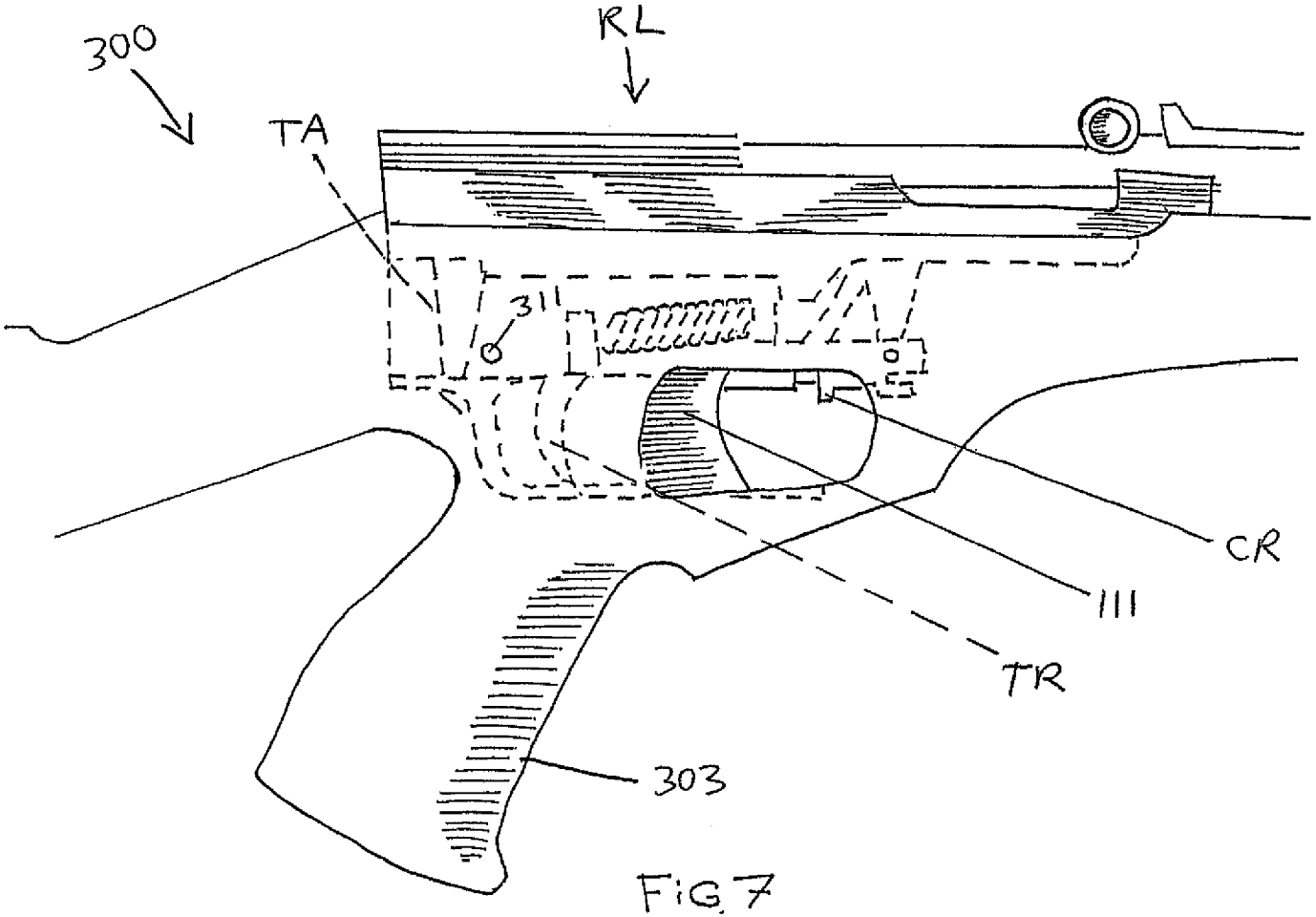
FIG. 7 is a side view of the modified stock of FIG. 6 in combination with an assault rifle and a trigger extension.

Now referring to FIGS. 5-7, trigger extension 100 may be engaged with trigger assembly TA, including trigger TR and trigger guard TG. Preferably, a forward portion of trigger guard TG is disposed within cavity 119 between rearwardly-extending arms 113 and 115 such that forward contact surface 111 is disposed forward of trigger guard TG. Trigger contact portion 117 is preferably disposed in a position within trigger guard TG and proximate trigger TR whereby movement of trigger extension 100 relative to trigger assembly TA may cause activation of trigger TR, and thus firing of the rifle.

In use, trigger extension 100 is preferably installed via sliding over trigger guard TG. Such sliding may be enabled via separation of rearwardly-extending arms 113 and 115 such that a dimension of second portion 119*b* of cavity 119 is sufficiently large to allow at least a portion of trigger guard TG to pass therethrough into first portion 119*a* of cavity 119. As shown in FIGS. 5 and 6, an upper portion of trigger extension 100 is preferably disposed in a position proximate trigger assembly TA, and optionally in sliding engagement therewith. Once trigger extension 100 has been so installed, rifle RL, including barrel BR, receiver RC, bolt assembly BA, trigger assembly TA, and magazine assembly MA, may be engaged with modified stock 300. Modified stock 300 preferably includes a butt 301, grip 303, trigger guard 305, receiver cover 307, and foregrip 309. Butt 301, grip 303, trigger guard 305, receiver cover 307 and foregrip 309 may be formed from monolithic body 300*a*, or may be formed from separate pieces and joined using conventional techniques.

For example, butt 301 may optionally be formed as a separate piece that is removable and/or collapsible, and may be attached via quick-release clips, slides, or the like, or via conventional mechanical fasteners. Similarly, foregrip 309 may be formed from a separate piece and may be removable, whereby replacement foregrips or foregrip covers may be installed, such as those made from differing materials, having different shapes or configurations, or merely having different appearances. Likewise, grip 303 may be removable and/or adjustable to enable stock 300 to be converted between a conventional rifle configuration and a sportsterized configuration.

In a preferred embodiment, such as one adapted for use with an SKS assault rifle, stock 300 includes a channel (not shown) formed in an upper surface thereof adapted to securely and removably receive barrel BR, receiver RC, bolt assembly BA, trigger assembly TA, and magazine assembly MA. Stock 300 further includes an opening formed in a lower surface thereof adapted to receive a magazine clip. Thus, rifle RL may be engaged with stock 300 by lowering rifle RL into the channel. As shown in FIG. 7, trigger TR of rifle RL is preferably enclosed by stock 300 when rifle RL is engaged with stock 300. More specifically, grip 303 is preferably disposed at position along a length thereof approximately the same as a position of trigger TR of trigger assembly TA. Accordingly, trigger guard 305 of stock 300 is preferably disposed in a position forward of trigger TR and approximately the same as a position of forward contact surface 111 of trigger extension 100. Thus, forward contact surface 111 is preferably accessible to a user for manipulation, and for firing of rifle RL. As a result of the advance positioning of grip 303, a distance to clip release CR may be reduced as compared to a grip positioned to allow direct access to trigger TR, whereby a user may preferably activate clip release CR while holding grip 303. Thus, one-handed operation of clip release CR is enabled by stock 300, wherein a user may remove and insert a magazine clip using a free hand, thereby decreasing a time necessary for replacement of a magazine clip.

Rifle RL may be secured to stock 300 via one or more fastener, such as a threaded fastener disposed through hole 311 and engaging a portion of trigger assembly TA, or the like. Additionally, cap 313 may be provided proximate foregrip 309 and secured thereto to prevent undesired removal of rifle RL from stock 300.

Figure 8:
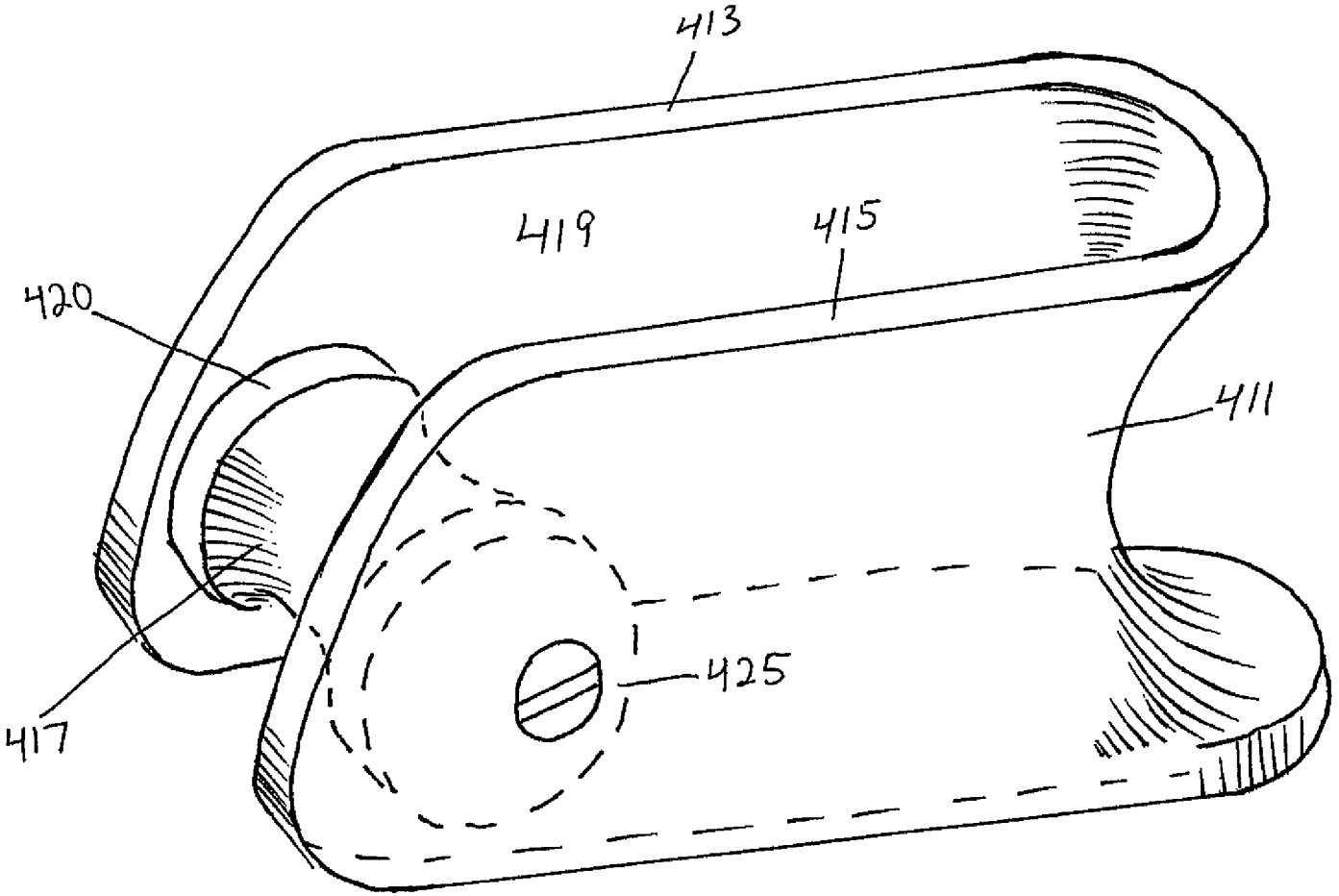
FIG. 8 is a perspective view of an adjustable-length trigger extension.
Figures 9, 10:
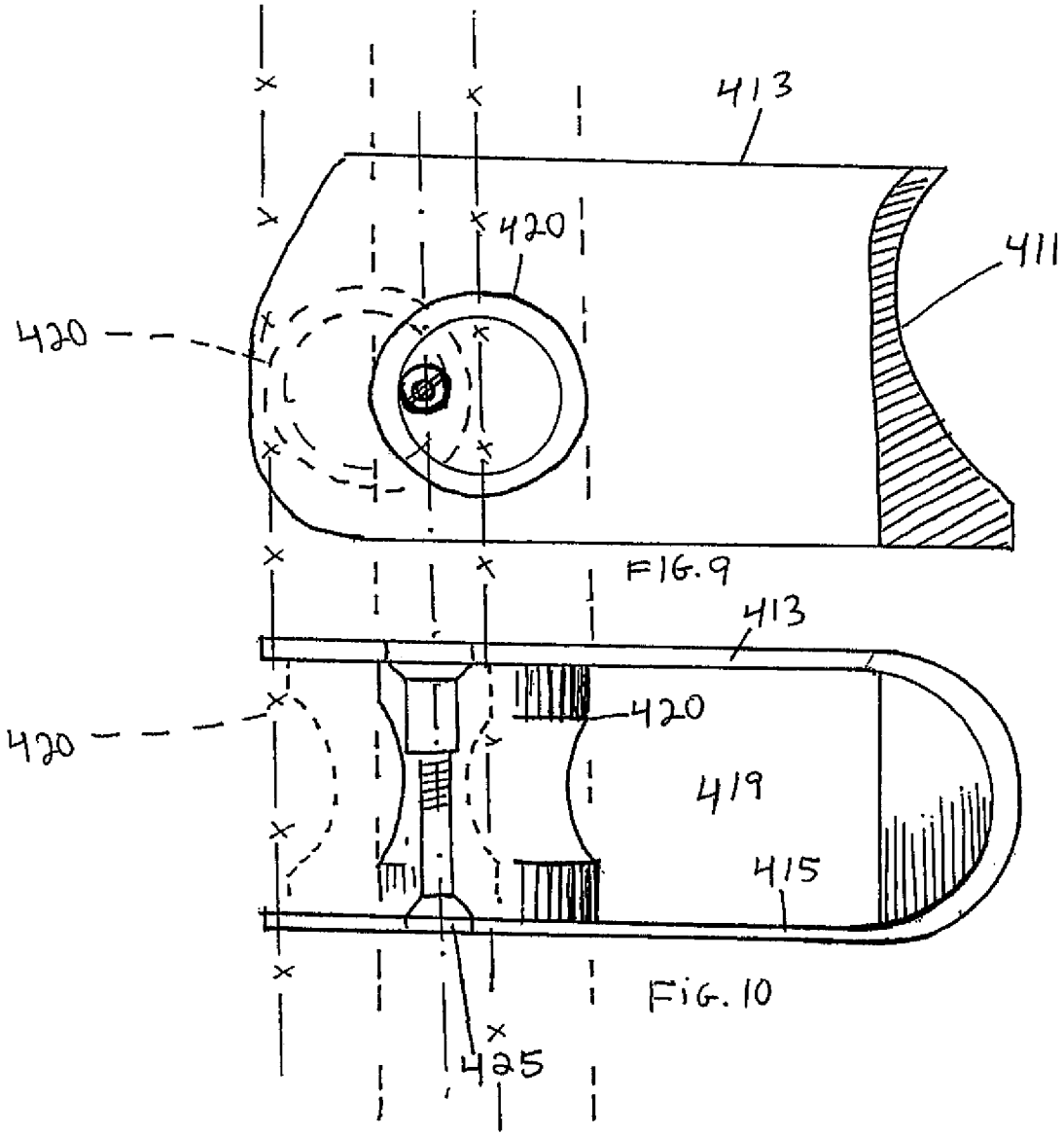
FIG. 9 is a side cross-sectional view of the trigger extension of FIG. 8.
FIG. 10 is a top view of the trigger extension of FIG. 8.

Now referring to FIGS. 8-10, trigger extension 400 according to an alternate embodiment of the invention preferably comprises body 401 defining forward contact portion 411 rearwardly-extending arms 413 and 415, trigger contact portion 417, and cavity 419. A position of trigger contact portion 417 is preferably adjustable relative to forward contact portion 411, whereby an effective length of trigger extension 400 may be adjustable. Such adjustment of the length of trigger extension 400 may enable a user to personalize trigger extension 400 for comfort, length of pull, or the like. Specifically, trigger contact portion 117 may be formed as a rotatable member, such as a round or oval member, preferably including a contoured surface adapted to securely engage a trigger. As shown, trigger contact portion 417 may be formed as a generally concave external circumferential surface of round member 420. Member 420 may be rotatably operable with rearwardly-extending arms 413 and 415 via threaded fastener 425 disposed therethrough. Fastener 425 is preferably located at a distance from a cross-sectional center of member 420, whereby rotation of member 420 about fastener 425 causes a cam action. That is to say, when member 420 is disposed in a first position 420', as shown in FIGS. 9 and 10, a section of trigger contact portion 417 facing to the rear, i.e. that will engage a trigger, is spaced from fastener 425 by a relatively short distance, whereas when member 420 is disposed in second position 420", an opposing section of trigger contact portion 417 faces to the rear, and is spaced from fastener 425 by a relatively greater distance.

As will be understood by those skilled in the art, alternative structures may be employed to accomplish adjustment in length of trigger extension 400, i.e. to change a distance between a section of the trigger contact portion that will contact the trigger and the forward contact portion. For example, member 420 may be adjustable by engagement with fastener 425 disposed in one of a plurality of spaced holes, wherein selection of one of the holes adjusts a relative position of the trigger contact portion. Similarly, such a plurality of holes may be employed in combination with fastener 425 disposed off-center through member 420, thereby allowing greater adjustment in length of trigger extension 400. Furthermore, length adjustment of trigger extension 400 may be accomplished via engagement of one of a plurality of interchangeable members 420 having different diameters. Likewise, many other mechanisms for altering an effective length of trigger extension 400 will be apparent to those ordinarily skilled in the art, and such alternative mechanisms may be employed without departing from the scope of the present invention.

Having thus described exemplary embodiments of the present invention, it should be noted by those skilled in the art that the within disclosures are exemplary only and that various other alternatives, adaptations, and modifications may be made within the scope and spirit of the present invention.

Accordingly, the present invention is not limited to the specific embodiments as illustrated herein, but is only limited by the following claims.

What is claimed is at least:

1. A trigger extension for use with a firearm having a trigger assembly comprised of a hammer, a trigger, a sear, a trigger guard and wherein the hammer, when cocked, is in operational contact with the sear, the trigger is housed within the trigger guard and is configured to operate the sear of the trigger assembly, comprising:

a body portion comprised of a forward contact surface and two rearwardly-extending arms;

said forward contact surface is configured to be located in front of the trigger guard and is adapted to be manipulated by a user to activate the trigger of the firearm;

said two rearwardly-extending arms are located proximate said forward contact surface at a proximal end thereof; and a trigger contact portion located proximate a distal end of said two rearwardly-extending arms, said trigger contact portion configured to engage the trigger of the trigger assembly, wherein said trigger contact portion is configured to be disposed generally within the trigger guard of the trigger assembly, and wherein said forward contact portion is configured to be disposed in a position generally forward of the trigger guard.

2. The trigger extension of claim 1, wherein said two rearwardly-extending arms define a cavity there between, wherein said cavity is adapted to receive at least a portion of the trigger guard of the trigger assembly.

3. The trigger extension of claim 2, wherein said cavity is adapted to allow sliding motion of said trigger extension relative to said trigger guard.

4. The trigger extension of claim 1, wherein said trigger contact portion defines a surface extending substantially completely between said two rearwardly-extending arms.

5. The trigger extension of claim 1, wherein a distance between said forward contact surface and said trigger contact portion is adjustable.

6. The trigger extension of claim 1, further comprising a cam member rotatably operable with said two rearwardly-extending arms, wherein said trigger contact portion comprises at least a portion of an outer circumferential surface of said cam member.

7. A trigger extension for use with a firearm having a trigger assembly comprised of a hammer, a trigger, a sear, a trigger guard and wherein the hammer, when cocked, is in operational contact with the sear, the trigger is housed within the trigger guard and is configured to operate the sear of the trigger assembly, comprised of:

a forward contact surface configured to be manipulated by a user to activate the trigger of the firearm;

at least one rearwardly-extending arm integrally connected to said forward contact surface;

wherein said forward contact surface and said at least one rearwardly-extending arm are together constructed as a unitary piece; and a trigger contact portion located proximate a back end of said at least one rearwardly-extending arm, said trigger contact portion configured to be operably engaged with the trigger of the trigger assembly, a distance between said forward contact surface and said trigger contact portion is adjustable;

wherein said trigger contact portion is configured to be disposed generally within the trigger guard of the trigger assembly, and wherein said forward contact surface is configured to be located in front of the trigger guard.

8. The trigger extension of claim 7, wherein said at least one rearwardly extending arm is two rearwardly-extending arms.

9. The trigger extension of claim 8, wherein said two rearwardly-extending arms define a cavity there between, wherein said cavity is adapted to receive at least a portion of the trigger guard of the trigger assembly.

10. The trigger extension of claim 9, wherein said cavity is adapted to allow sliding motion of said trigger extension relative to said trigger guard.

11. The trigger extension of claim 7, further comprising a cavity adapted to receive the trigger guard of the trigger assembly.

12. The trigger extension of claim 11, wherein said cavity is adapted to allow sliding motion of said trigger extension relative to said trigger guard.

13. The trigger extension of claim 8, wherein said trigger contact portion defines a surface extending substantially completely between said two rearwardly-extending arms.

14. The trigger extension of claim 7, further comprising a cam member rotatably operable with said at least one rearwardly-extending arm, wherein said trigger contact portion comprises at least a portion of an outer circumferential surface of said cam member.

* * * * *